US006857701B1

(12) United States Patent
Liu

(10) Patent No.: US 6,857,701 B1
(45) Date of Patent: Feb. 22, 2005

(54) SWING RACK HAVING A SEAT DOCK WITH ADJUSTABLE ANGLE

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 10/673,148

(22) Filed: Sep. 30, 2003

(51) Int. Cl.[7] ..... A47C 15/00

(52) U.S. Cl. ..... 297/281; 297/354.13; 297/282; 5/126; 472/118

(58) Field of Search ..... 297/273, 281, 297/282, 354.13; 5/124, 126, 127, 129; 472/118, 125

(56) References Cited

U.S. PATENT DOCUMENTS 1,159,069 A * 11/1915 Motznik et al. ..... 297/281
1,973,229 A * 9/1934 Smith ..... 5/126
4,790,599 A * 12/1988 Goldman ..... 297/327
5,957,780 A * 9/1999 Grazioli ..... 472/118
6,348,005 B1 * 2/2002 Tseng ..... 472/118
6,648,768 B1 * 11/2003 Tseng ..... 472/118
6,672,665 B1 * 1/2004 Tseng ..... 297/281
6,715,831 B1 * 4/2004 Tseng ..... 297/281

* cited by examiner

*Primary Examiner*—Peter M. Cuomo
*Assistant Examiner*—Joseph Edell
(74) *Attorney, Agent, or Firm*—Birch, Stewart, Kolasch & Birch, LLP

(57) ABSTRACT

A swing rack having a seat dock with adjustable angle includes a loading frame which has two sides coupling respectively with an anchor dock. The anchor dock has a trough for holding a sliding member which is coupled with the seat dock. The seat dock includes a seat rack, a backrest rack and a bracing bar bridging therebetween. A bracing bracket is provided which has a retaining element. The loading frame has a first anchor member. The stretcher between the legs at two sides has a second anchor member. The bracing bracket may be latched on the first and second anchor member to form a secure anchoring to support users at the sitting and lying angle.

5 Claims, 10 Drawing Sheets

SWING RACK HAVING A SEAT DOCK WITH ADJUSTABLE ANGLE

FIELD OF THE INVENTION

The present invention relates to a swing rack that has a seat dock with adjustable angle and particularly to a swing rack for providing adjustable sitting and lying angles to enhance users comfort.

BACKGROUND OF THE INVENTION

Conventional swings that have a single sitting or lying angle generally include a support rack which consists of a pair of legs on two sides and a top rail bridging the top ends of the legs, a suspension means pivotally coupling on the top rail, a frame dock mounting on the suspension means and a seat dock pivotally coupling on the frame dock. The frame dock has a front bar and a rear bar corresponding to each other. The rear bar is coupled with two anchor mechanisms. The seat dock has a seat rack and a backrest rack corresponding to each other. There is a bracing bracket pivotally coupled on the backrest rack and extended downwards. When the bracing bracket is latched on the anchor mechanisms, the seat rack and the backrest rack form a sitting position. When the backrest rack is latched on the rear bar of the frame dock, the seat rack and the backrest rack are extended flatly to form a lying position. While the swings of such a construction can provide a sitting angle and a lying angle, they still have drawbacks, notably:

1. The center portion of the seat dock is hollow whether at the sitting angle and lying angle. Users are supported only by the seat dock cover. Moreover, the seat dock and the legs are coupled only by fastening plates through a pivot bar set, the fastening plates cannot provide sufficient bracing strength when people are lying down, hence they could sag abruptly and cause ill comfort to people. Their capability for supporting the load also is a concern. Moreover, the pivotal joint of the seat rack and the backrest rack is movable. In the event of the receiving force being uneven (such as user sits on the seat rack first, then lies down slowly, the weight first concentrates on the pivotal joint of the seat rack and the backrest rack), the pivotal joint will be moved downwards abruptly and cause the backrest rack folding to the seat rack. It is prone to squeeze people and results in injury.

2. Besides the circumstance mentioned above, the abrupt folding also relates to the situation where the bracing bracket is anchored only when latching on the anchor mechanisms. In the lying condition, the bracing bracket has no anchor means. Thus when the abrupt folding occurs, the bracing bracket moves upwards and sways. It tends to hit users and cause injury. Moreover, in the event that users want to move the swing location, as the bracing bracket is not properly latched on the anchor mechanisms, it will sway and hit the rear bar. The enameled surface of the rear bar and bracing bracket could be scraped and result in a damaged appearance.

SUMMARY OF THE INVENTION

Therefore the primary object of the invention is to solve the aforesaid disadvantages and eliminate the shortcomings. The invention provides a swing rack that has a seat dock with adjustable angle. It has anchor docks on two sides of the loading frame. The anchor dock has a trough to hold a sliding member which is coupled with seat dock consisting of a seat rack, a backrest rack and a bracing bar bridging the seat rack and the backrest rack. A bracing bracket is provided which has a retaining element. The loading frame has a first anchor element corresponding to the retaining element. The stretcher between the legs has a second anchor element. The bracing bracket may be latched respectively on the first anchor element and the second anchor element at the sitting and lying angles and to be confined by the retaining element. Thus users may have a desired support both at the sitting and lying angles, and the bracing bracket may be securely anchored.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 3:
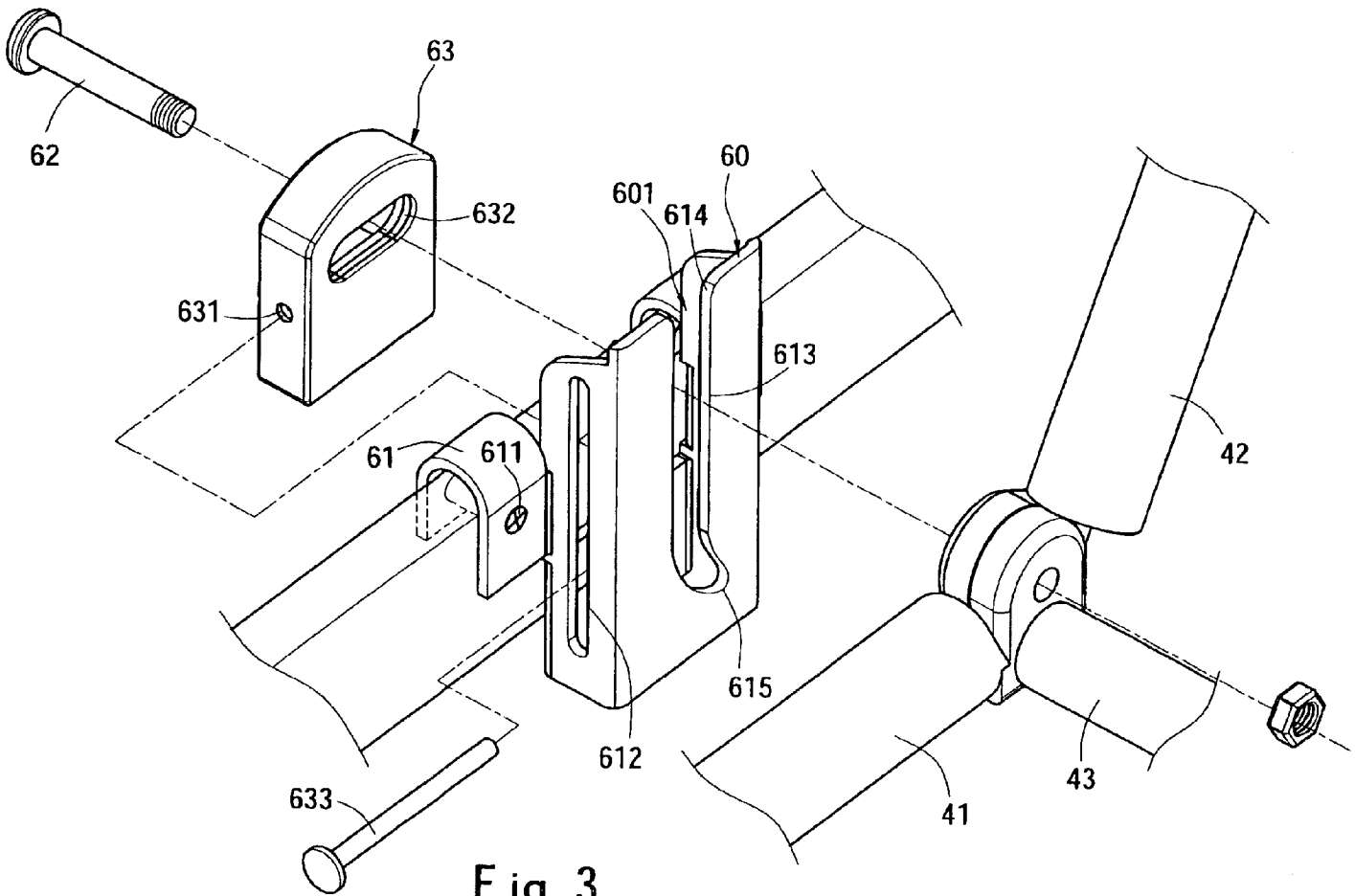
FIG. 3 is an exploded view of the anchor dock according to the invention.
Figure 4:
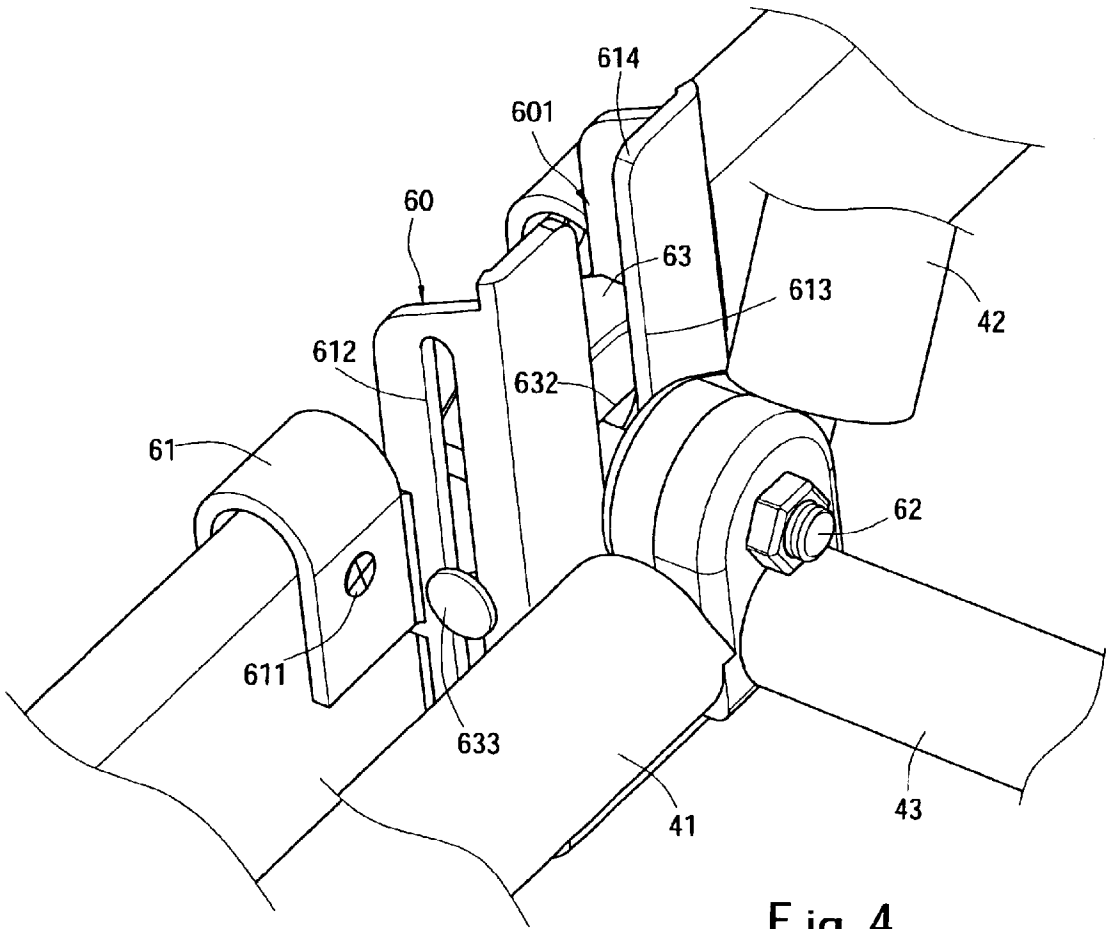
FIG. 4 is a perspective view of the anchor dock.

Please referring to FIGS. 1A, 1B, 3 and 4, the swing rack 1 according to the invention has a seat dock 40 with an adjustable angle. It mainly includes a support rack 10 which consists of legs 11 on two sides and a top rail 12 bridging the top ends of the legs 11. The top rail 12 is coupled with two suspension units 20 on two sides. The suspension units 20 hang a frame dock 30 at the bottom end. The frame dock 30 includes two side frames 31 and a loading frame 32 bridging the side frames 31. The loading frame 32 holds a seat dock 40 thereon. As shown in FIGS. 3 and 4, the loading frame 32 has anchor docks 60 on two sides. Each anchor dock 60 includes an anchor member 61 for fastening to the loading frame 32 through a fastening element 611. The anchor dock 60 has a trough 601 for holding a sliding member 63. The seat dock 40 includes a seat rack 41 and a backrest rack 42 that have one end pivotally coupled on the sliding member 63 in a coaxial manner through a fastening element 62. The coupling end of the seat rack 41 and the backrest rack 42 is further coupled with a bracing bar 43. The anchor dock 60 has retaining slot 612 on one side and a sliding slot 613 on another side facing the coupling end of the seat rack 41 and the backrest rack 42. The sliding slot 613 has an opening end 614 and a retaining end 615. The sliding member 63 has a transverse slot 632 on one side corresponding to the retaining end 615 and a fastening hole 631 on another side corresponding to the retaining slot 612. For assembly, slide the coupling end of the seat rack 41 and the backrest rack 42 into the sliding slot 613 from the opening end 614, insert the fastening element 62 through the transverse slot 632 of the sliding member 63 to engage with the coupling end of the seat rack 41 and the backrest rack 42. Fasten a retaining element 633 through the retaining slot 612 and the fastening hole 631 to anchor the sliding member 63 on the anchor dock 60. Furthermore, the backrest rack 42 is pivotally coupled with a bracing bracket 44. The backrest rack 42 and the seat rack 41 may be adjusted to form a sitting angle for seating people. The bracing bracket 44 has a retaining element 50. The loading frame 32 has a first anchor member 33 corresponding to the retaining member 50 so that the bracing bracket 44 may be latched on the first anchor member 33 to form the sitting angle and be confined by the retaining element 50 for anchoring. When the backrest rack 42 and the seat rack 41 are adjusted to the lying angle, a stretcher 13 of the legs 11 has a second anchor member 131 to latch the bracing bracket 44 for anchoring.

Figure 1A:
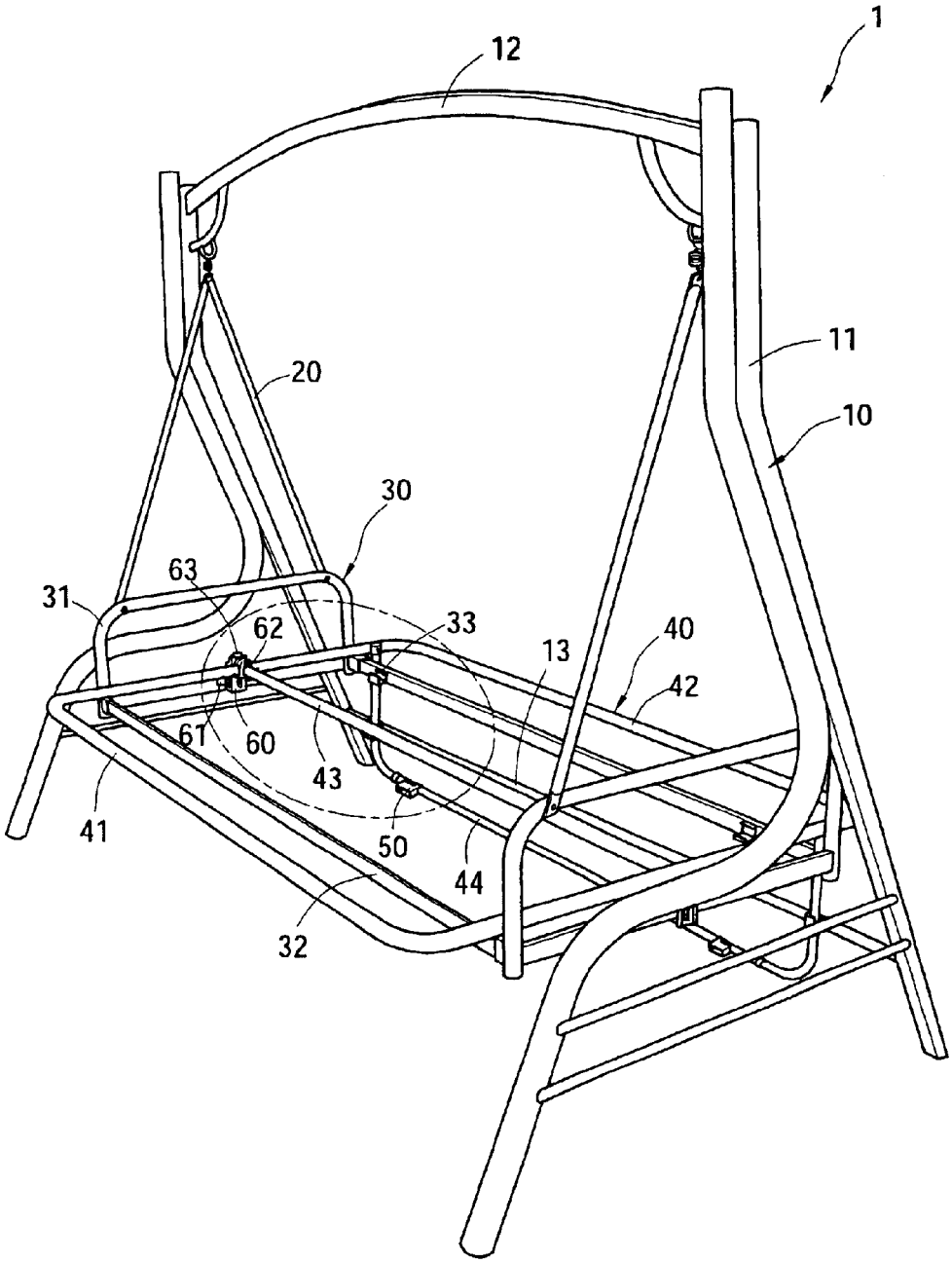
FIG. 1A is a perspective view of the present invention.
Figure 1B:
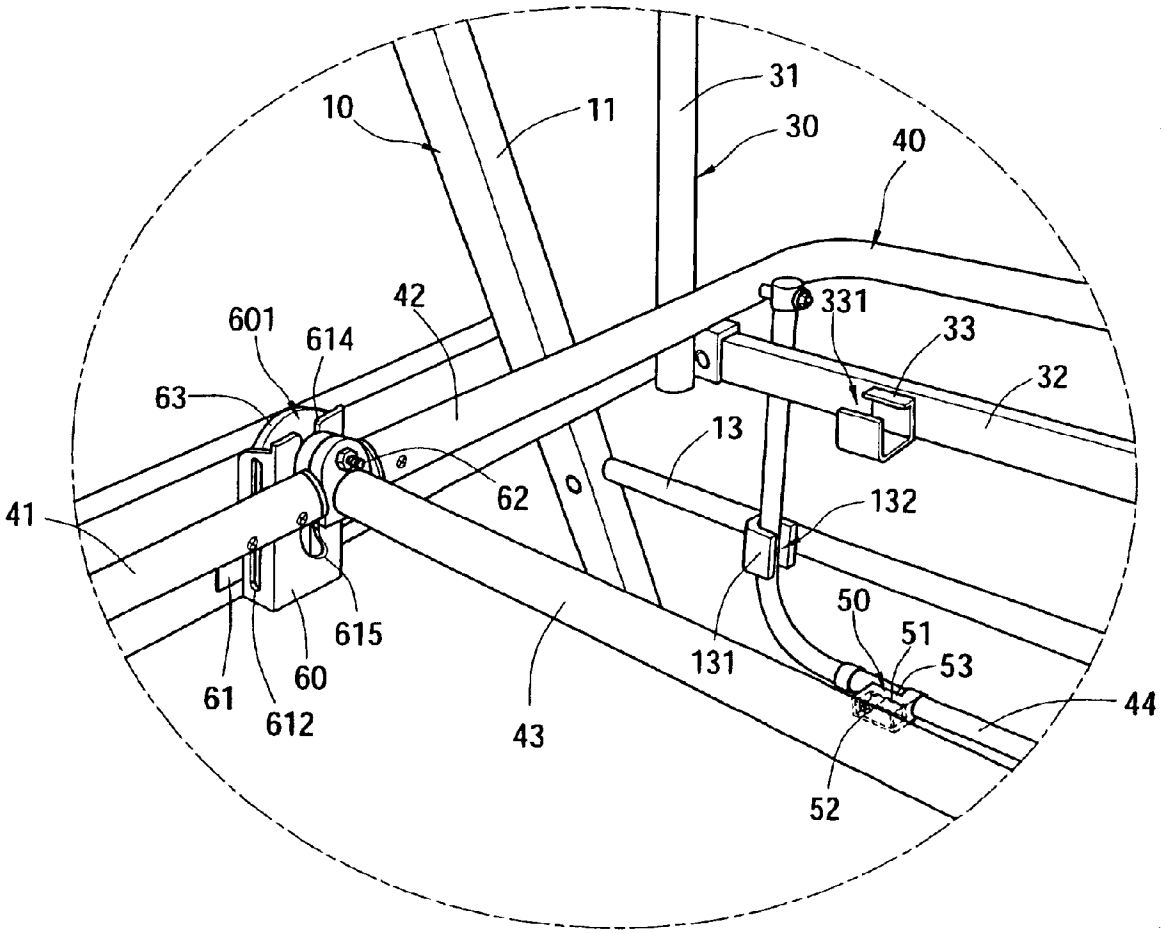
FIG. 1B is a fragmentary enlarged view according to FIG. 1A.
Figure 2A:
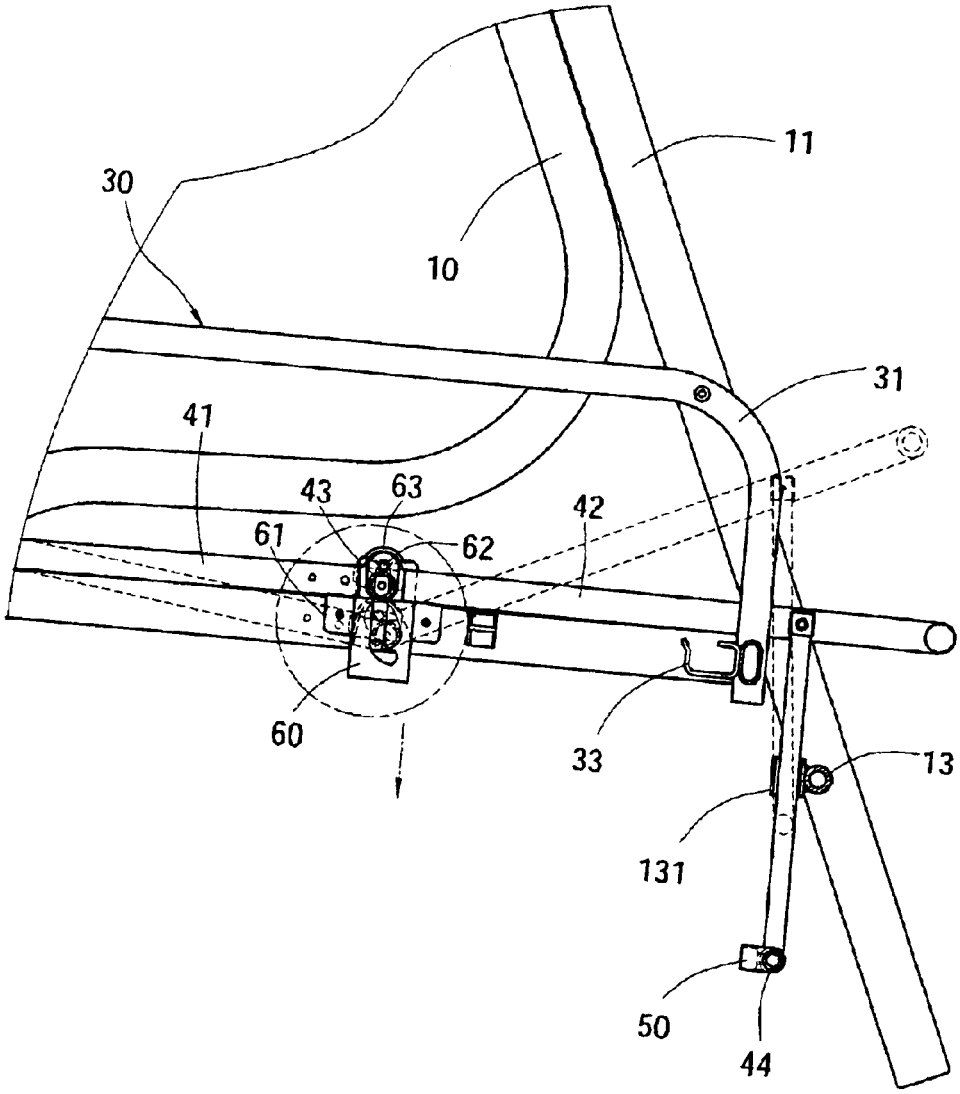
FIG. 2A is a schematic view of movement according to the anchor dock.
Figure 2B:
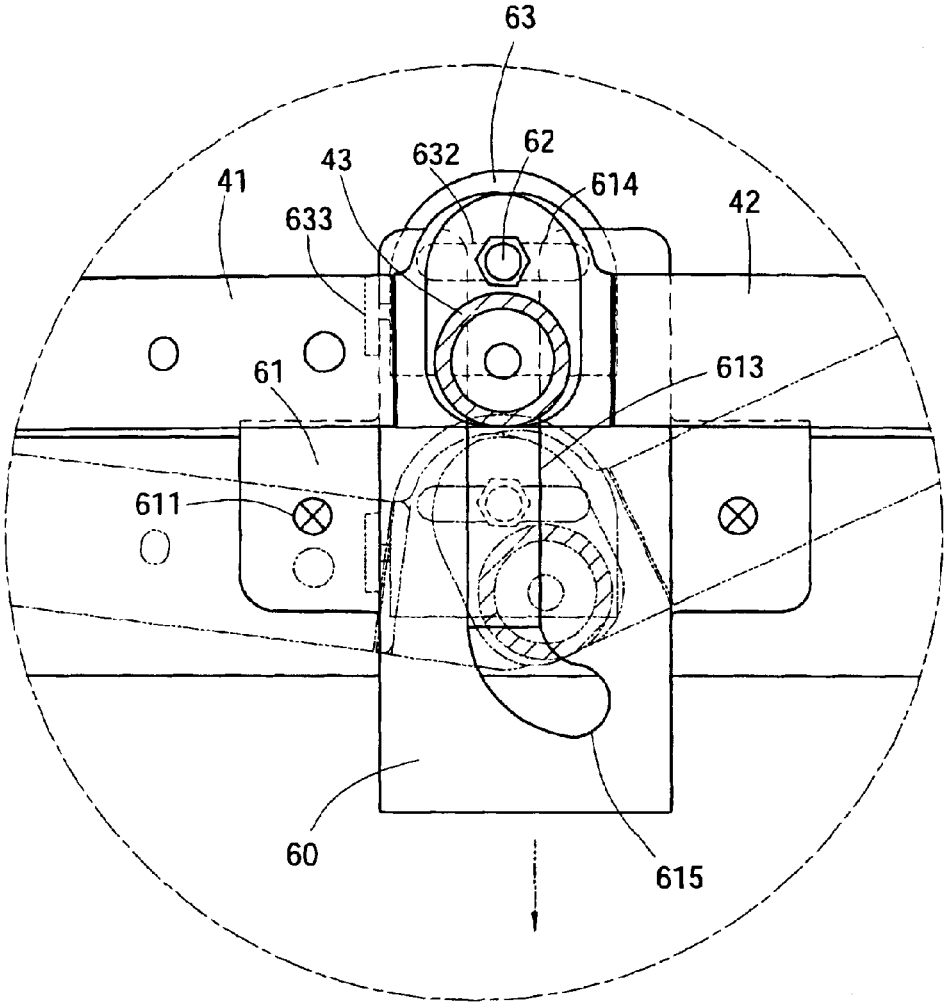
FIG. 2B is a fragmentary enlarged view according to FIG. 2A.

Referring to FIGS. 1B, 2A and 2B, when the backrest rack 42 and the seat rack 41 are adjusted to the lying angle, they are extended flatly about 180°. In that condition, the bracing bracket 44 may be latched on the second anchor member 131 for anchoring. The second anchor member 131 has an opening 132 larger than the tube diameter of the bracing rack 44 so that the bracing rack 44 may be latched through the opening; 132 without generating swaying forwards and backwards. When there is a desire to move the swing rack 1, the bracing rack 44 may be anchored securely without swaying to prevent scraping the enameled surface and damaging the appearance. In addition, the bracing bar 43 bridging the coupling ends of the seat rack 41 and the backrest rack 42 can provide improved support when users lie on the lying angle.

Figure 1C:
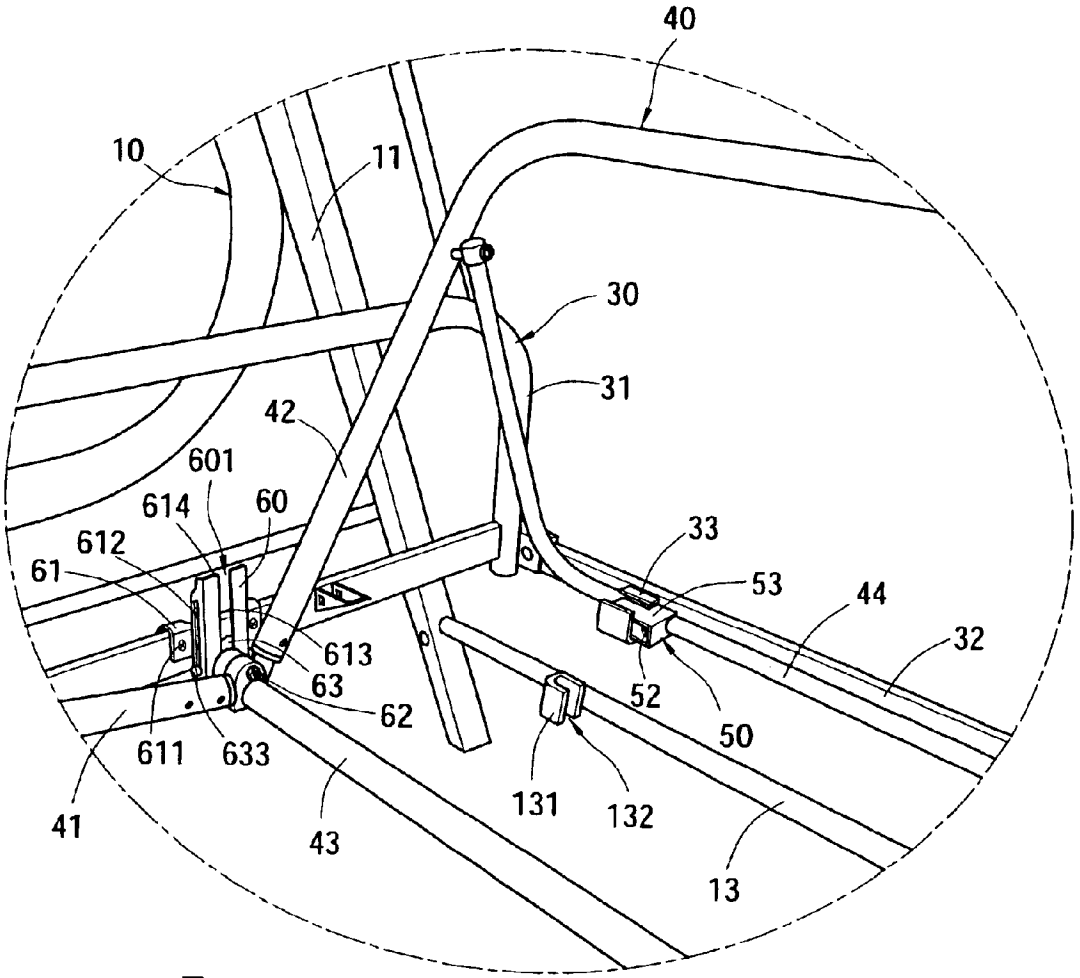
FIG. 1C is a schematic view of movement according to FIG. 1B.
Figure 2C:
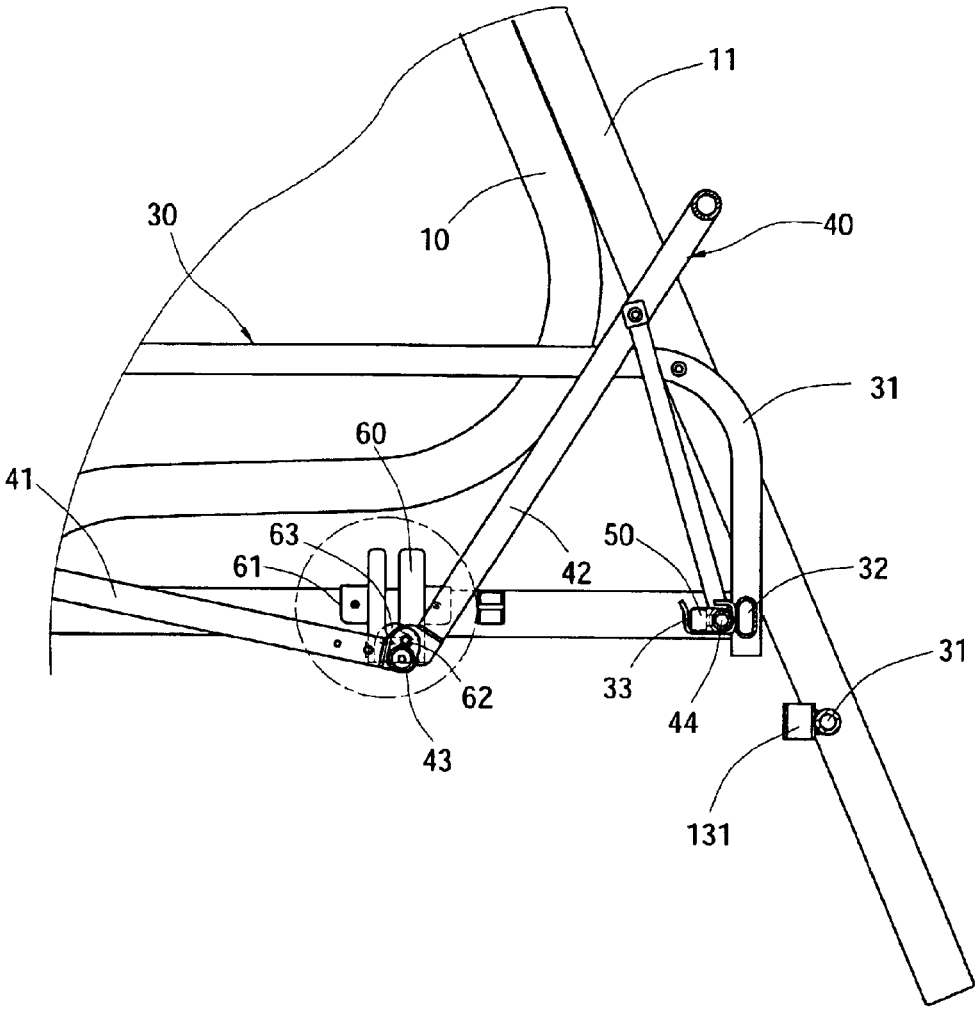
FIG. 2C is a schematic view of movement according to the anchor dock.
Figure 2D:
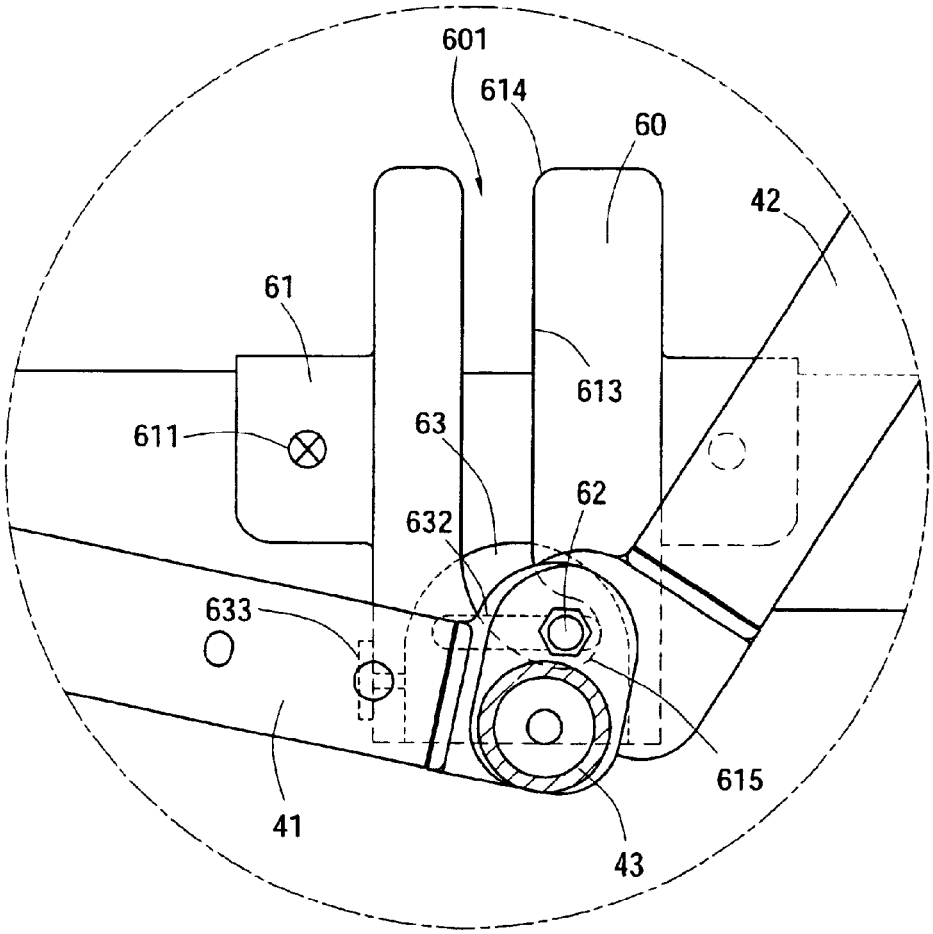
FIG. 2D is a fragmentary enlarged view according to FIG. 2C.
Figure 5A:
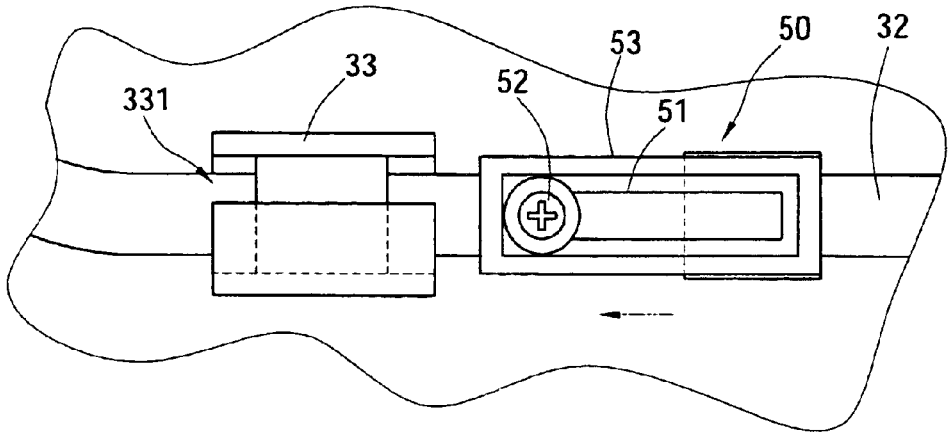
FIGS. 5A and 5B are schematic views of movement according to the retaining element.
Figure 5B:
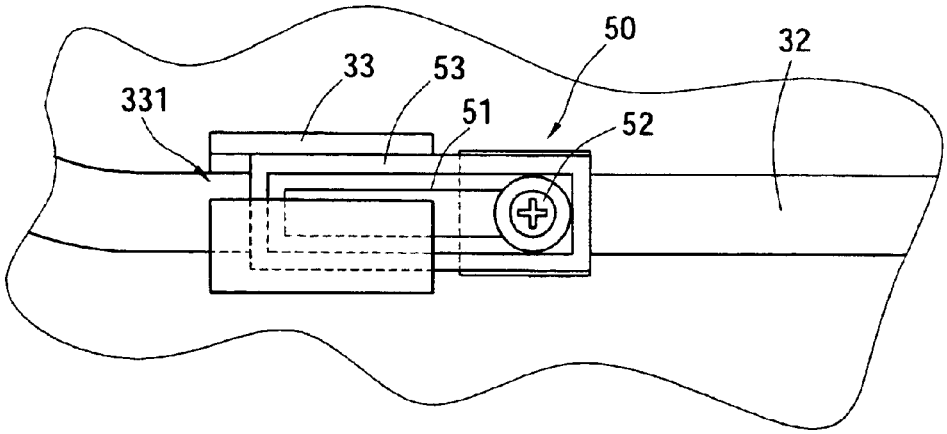

Referring to FIGS. 1C, 5A and 5B, when users want to change the swing rack 1 to the sitting angle, first, release the latching relationship between the bracing bracket 44 and the second anchor member 131; move the backrest rack 42 upwards relative to the seat rack 41, and in the mean time, the bracing bracket 44 is moved upwards; latch the bracing bracket 44 through the opening 331 into the first anchor member 33; a slot 51 coupled with a confining element 52 for anchoring the retaining element 50 on the bracing bracket 44 and a retaining section 53 extended from one end corresponding to the opening 132. As shown in FIG. 1B, the retaining section 53 may be latched through the opening 331 to fill the gap between the bracing bracket 44 and the first anchor member 33 to form a secured anchoring relationship. When the backrest rack 42 is adjusted relative to the seat rack 41 to form the sitting angle, as the seat rack 41, backrest rack 42 and bracing bar 43 are pivotally coupled with the sliding member 63, and the sliding member 63 is moved downwards in the trough 601 of the anchor dock 60 until reaching the bottom where the bracing bracket 44 is latched on the first anchor member 33 as shown in FIG. 2C, the bracing bracket 44 may be anchored on the first anchor member 33 through the retaining element 50, and the fastening element 62 may be moved transversely in the transverse slot 632 of the sliding member 63 and the retaining end 615 of the anchor dock 60 as shown in FIG. 2D, thereby the sitting angle may be obtained. Similarly, the bracing bar 43 can provide reinforced support to eight. And the coupling end of the seat rack 41 and the backrest rack 42 may be prevented from being confined to the retaining end 615 and the first anchor member 33, thereby abnormal moving of the backrest rack 42 may be avoided to provide a double safeguard effect. Thus the entire swing 1 is more comfortable and safer in use.

What is claimed is:

1. A swing rack having a seat dock with adjustable angle, comprising:

a support rack which has legs on two sides and a top rail bridging top ends of the legs; and two suspension units coupled on two sides of the top rail for hanging a frame dock, the frame dock having two side frames and a loading frame bridging the two side frames, the loading frame holding the seat dock;

wherein the loading frame having two sides each has an anchor dock which is fastened to the loading frame by an anchor member through a fastening element, the anchor dock having a trough for holding a sliding member, the seat dock including a seat rack and a backrest rack that each have one end pivotally coupled at a coupling end on the sliding member and fastened thereon through a second fastening element in a coaxial manner, the coupling end of the seat rack and the backrest rack being connected to a bracing bar, the backrest rack being coupled with a bracing bracket which couples with a retaining element, the backrest rack being adjustable relative to the seat rack to form a sitting angle for seating people, the loading frame having a first anchor member cooperating with the retaining member so that the bracing bracket is allowed to form the sitting angle and the retaining element is coupled to the first anchor member to form anchoring, the backrest rack being adjustable relative to the seat rack to form a lying angle, the legs being bridged by a stretcher which is coupled with a second anchor member to latch the bracing bracket at the lying angle.

2. The swing rack of claim 1, wherein the first anchor member and the second anchor member have respectively an opening which is larger than the tube diameter of the bracing bracket.

3. The swing rack of claim 1, wherein the retaining element has a slot which couples with a confining element for anchoring the retaining element on the bracing bracket, the retaining element having a retaining section extending from one end thereof corresponding to the opening.

4. The swing rack of claim 1, wherein the anchor dock has a retaining slot, the sliding member having a fastening hole corresponding to the retaining slot to engage with a second retaining element through the retaining slot.

5. The swing rack of claim 1, wherein the anchor dock has a sliding slot facing the coupling end of the seat rack and the backrest rack, the sliding slot having an opening end and a retaining end, the sliding member having a transverse slot corresponding to the retaining end.

* * * * *